US008728690B2

(12) United States Patent
Wu

(10) Patent No.: US 8,728,690 B2
(45) **Date of Patent: *May 20, 2014**

(54) SPIRODILACTAM-DOPED CHARGE TRANSPORT LAYER FOR IMAGING DEVICE

(75) Inventor: Jin Wu, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 563 days.

This patent is subject to a terminal disclaimer.

(21) Appl. No.: 12/910,791

(22) Filed: Oct. 23, 2010

(65) Prior Publication Data

US 2012/0100475 A1 Apr. 26, 2012

(51) Int. Cl.
*G03G 5/05* (2006.01)

(52) U.S. Cl.
USPC ..... 430/59.6; 430/58.05; 430/133; 430/134; 399/159

(58) Field of Classification Search
USPC ..... 430/59.6, 58.05, 133, 134; 399/159
See application file for complete search history.

(56) References Cited

U.S. PATENT DOCUMENTS

| | | | | |
|---|---|---|---|---|
| 4,663,259 | A * | 5/1987 | Fujimura et al. | 430/59.6 |
| 4,939,251 | A * | 7/1990 | Wang | 540/489 |
| 5,610,690 | A * | 3/1997 | Yoshihara et al. | 399/167 |
| 6,080,833 | A * | 6/2000 | Otsuji et al. | 528/201 |
| 8,304,152 | B2 * | 11/2012 | Wu | 430/58.8 |

OTHER PUBLICATIONS

Diamond, Arthur S & David Weiss (eds.) Handbook of Imaging Materials, 2nd ed.. New York: Marcel-Dekker, Inc. (Nov. 2001) pp. 145-164.*

Zhou, Hui et al. "New spirolactam polymers" Polymer 47 (2006), pp. 6927-6930.*

* cited by examiner

*Primary Examiner* — Christopher Rodee
(74) *Attorney, Agent, or Firm* — MDIP LLC

(57) ABSTRACT

A photoreceptor charge transport layer containing a spirodilactam and/or a lubricant has superior wear resistance.

20 Claims, No Drawings

SPIRODILACTAM-DOPED CHARGE TRANSPORT LAYER FOR IMAGING DEVICE

FIELD

A novel charge transport layer (CTL) for an electrostatographic imaging device component is provided. The imaging device component can be used in electrophotographic or electrostatographic devices, such as, xerographic devices.

BACKGROUND

In the electrostatographic imaging arts, the photoactive portions of most photoreceptors now are composed of organic materials. Nevertheless, the rigor and repetitive use thereof command durability of the components, such as, the photoreceptors.

High speed electrophotographic copiers, duplicators and printers often experience degradation of image quality over extended cycling. The high speed imaging, duplicating and printing devices place stringent requirements on the imaging device components. For example, the functional layers of modern photoreceptors must be flexible, adhere well to adjacent layers and exhibit predictable electrical characteristics within narrow operating limits to provide acceptable toner images over many thousands of cycles.

To provide a sufficient charge transporting capability, the charge transport molecule loading level can be high, for example, around 50% by weight of the total weight of the CTL. High charge transport molecule content can lead to poor physical properties of the photoreceptor, for example, a decrease in mechanical strength. Moreover, higher charge transport molecule amounts add to the cost of manufacturing photoreceptors.

A premium is placed on photoreceptor life where a major factor limiting longevity is repetitive use and wear. For example, many imaging devices now use a smaller diameter photoreceptor. The smaller diameter photoreceptors exacerbate the wear problem because, for example, several revolutions of the drum are required to image a single page.

Hence, a problem to be solved is developing photoreceptors which are durable without sacrificing the properties and functions thereof. That problem was solved by developing a spirodilactam-doped CTL with increased wear resistance for a photoreceptor.

SUMMARY

According to aspects disclosed herein, there is provided a photoreceptor charge transport layer (CTL) composition comprising a film-forming material, such as, a polycarbonate, a lubricant and a spirodilactam.

One disclosed feature of the embodiments is a photoreceptor comprising a CTL comprising a film-forming material, such as, a polycarbonate, a lubricant and a spirodilactam.

Another disclosed embodiment is an imaging or printing device comprising a photoreceptor comprising a CTL comprising a film-forming material, such as, a polycarbonate, a lubricant and a spirodilactam.

DETAILED DESCRIPTION

As used herein, the term, "electrostatographic," or grammatic versions thereof, is used interchangeably with the terms, "electrophotographic" and "xerographic." The terms, "charge blocking layer" and "blocking layer," are used interchangeably with the terms, "undercoat layer" or "undercoat," or grammatic versions thereof. "Photoreceptor," is used interchangeably with, "photoconductor," "imaging member" or "imaging component," or grammatic versions thereof.

For the purposes of the instant application, "about," is meant to indicate a deviation of no more than 20% of a stated value or a mean value.

In electrostatographic reproducing or imaging devices, including, for example, a digital copier, an image-on-image copier, a contact electrostatic printing device, a bookmarking device, a facsimile device, a printer, a multifunction device, a scanning device and any other such device, a printed output is provided, whether black and white or color, or a light image of an original is recorded in the form of an electrostatic latent image on an imaging device component, such as, a photoreceptor, which may be present as an integral component of an imaging device or as a replaceable component or module of an imaging device, and that latent image is rendered visible using electroscopic, finely divided, colored or pigmented particles, or toner. The imaging device component or photoreceptor can be used in electrophotographic (xerographic) imaging processes and devices, for example, as a flexible belt or in a rigid drum configuration. Other components may include a flexible intermediate image transfer belt, which can be seamless or seamed.

The imaging device component, the photoreceptor, generally comprises one or more functional layers. Certain photoreceptors include a photoconductive layer or layers formed on an electrically conductive substrate or surface. The photoconductive layer is an insulator in the dark so that electric charge is retained on the surface thereof, which charge is dissipated on exposure to light. In some embodiments of interest, a photoreceptor includes a CTL comprising a spirodilactam.

One type of composite photoconductive layer used in xerography is illustrated in U.S. Pat. No. 4,265,990 which describes an imaging device component having at least two electrically operative layers, a photoconductive layer which photogenerates holes and injects the photogenerated holes into a CTL. The photoreceptors can carry a uniform negative or positive electrostatic charge to generate an image which is visualized with finely divided electroscopic colored or pigmented particles.

Embodiments of the present imaging device component or photoreceptor can be used in an electrophotographic image forming device or printing device. Hence, the imaging device component or photoreceptor is electrostatically charged and then is exposed to a pattern of activating electromagnetic radiation, such as light, which dissipates the charge in the illuminated areas of the imaging device component while leaving behind an electrostatic latent image in the non-illuminated areas. The electrostatic latent image then is developed at one or more developing stations to form a visible image by depositing finely divided electroscopic colored, dyed or pigmented particles, or toner, for example, from a developer composition, on the surface of the imaging component. The resulting visible image on the photoreceptor is transferred to a suitable receiving member, such as a paper. Alternatively, the developed image can be transferred to an intermediate transfer device, such as a belt or a drum, and the image then is transferred to a receiving member, such as a paper, or various other receiving members or substrates, such as, a cloth, a polymer, a plastic, a metal and so on, which can be presented in any of a variety of forms, such as a flat surface, a sheet or a curved surface. The transferred colored particles are fixed or fused to the receiving member by any of a variety of means, such as, by exposure to elevated temperature and/or pressure.

Thus, a photoreceptor can include a support or substrate; which may comprise a conductive surface or a conductive layer or layers (which may be referred to herein as a ground plane layer) on an inert support; a charge generating layer (CGL); and a CTL. Other optional functional layers that can be included in a photoreceptor include a hole blocking layer; an undercoat; an adhesive interface layer; an overcoat or protective layer; a ground strip; and an anti-curl back coating layer. It will be appreciated that one or more of the layers may be combined into a single layer.

The Substrate

The imaging device component substrate (or support) may be opaque or substantially transparent, and may comprise any suitable organic or inorganic material having the requisite mechanical properties. The entire substrate can comprise an electrically conductive material, or an electrically conductive material can be a coating on an inert substrate. Any suitable electrically conductive material can be employed, such as, copper, brass, nickel, zinc, chromium, stainless steel, conductive plastics and rubbers, aluminum, semitransparent aluminum, steel, cadmium, silver, gold, indium, tin, zirconium, niobium, tantalum, vanadium, hafnium, titanium, tungsten, molybdenum and so on; or a paper, a plastic, a resin, a polymer and the like rendered conductive by the inclusion of a suitable conductive material therein; metal oxides, including tin oxide and indium tin oxide; and the like. The conductive material can comprise a single of the above-mentioned materials, such as, a single metallic compound, or a plurality of materials and/or a plurality of layers of different components, such as, a metal or an oxide, plural metals and so on.

The substrate can be an insulating material including inorganic or organic polymeric materials, such as a commercially available biaxially oriented polyethylene terephthalate, a commercially available polyethylene naphthalate and so on, with a ground plane layer comprising a conductive coating comprising one or more of the materials provided hereinabove, including a titanium or a titanium/zirconium coating, or a layer of an organic or inorganic material having a semiconductive surface layer, such as indium tin oxide, aluminum, titanium and the like. Thus, a substrate can be a plastic, a resin, a polymer and so on, such as a polycarbonate, a polyamide, a polyester, a polypropylene, a polyurethane, a polyethylene and so on.

The substrate may have a number of many different configurations, such as, for example, a plate, a sheet, a film, a cylinder, a drum, a scroll, a flexible belt, which may be seamed or seamless, and the like.

The thickness of the substrate can depend on any of a number of factors, including flexibility, mechanical performance and economic considerations. The thickness of the substrate may range from about 25 μm to about 3 mm. In embodiments of a flexible imaging belt, the thickness of a substrate can be from about 50 μm to about 200 μm for flexibility and to minimize induced imaging device component surface bending stress when a imaging device component belt is cycled around small diameter rollers in a machine belt support module, for example, 19 mm diameter rollers.

Generally, a substrate is not soluble in any of the solvents used in the coating layer solutions, can be optically transparent or semi-transparent, and can be thermally stable up to a temperature of about 150° C. or more.

The Conductive Layer

When a conductive ground plane layer is present, the layer may vary in thickness depending on the optical transparency and flexibility desired for the electrophotographic imaging device component. When an imaging flexible belt is used, the thickness of the conductive layer on the substrate, for example, a titanium and/or a zirconium conductive layer produced by sputtering, typically ranges from about 2 nm to about 75 nm in thickness to allow adequate light transmission for proper back erase. In other embodiments, a conductive layer can be from about 10 nm to about 20 nm in thickness for a combination of, for example, electrical conductivity, flexibility and light transmission. For rear erase exposure, a conductive layer light transparency of at least about 15% can be used. The conductive layer may be an electrically conductive metal layer which may be formed, for example, on the substrate by any suitable coating technique, such as a vacuum depositing, dipping or sputtering and so on as taught herein or as known in the art, and the coating dried on the substrate using methods taught herein or known in the art. (This and any of the methods for making a layer as taught herein may be practiced for making any other layer of a photoreceptor.) Typical metals suitable for use in a conductive layer include aluminum, zirconium, niobium, tantalum, vanadium, hafnium, titanium, nickel, stainless steel, chromium, tungsten, molybdenum, combinations thereof and the like. The conductive layer need not be limited to metals. Hence, other examples of conductive layers may be combinations of materials such as conductive indium tin oxide as a transparent layer for light having a wavelength between about 4000 Å and about 9000 Å or a conductive carbon black dispersed in a plastic binder as an opaque conductive layer.

The Hole Blocking Layer

An optional hole blocking layer may be applied, for example, to the undercoat. Any suitable positive charge (hole) blocking layer capable of forming an effective barrier to the injection of holes from the adjacent conductive layer or substrate to the photoconductive layer(s) or CGL may be used. The hole blocking layer may include polymers, such as, a polyvinylbutyral, epoxy resins, polyesters, polysiloxanes, polyamides, polyurethanes, methacrylates, such as hydroxyethyl methacrylate (HEMA), hydroxylpropyl celluloses, polyphosphazines and the like, or may comprise nitrogen-containing siloxanes or silanes, or nitrogen-containing titanium or zirconium compounds, such as, titanate and zirconate. Such film-forming materials can be used to make any of the layers taught herein. The hole blocking layer may have a thickness of from about 0.2 μm to about 10 μm, depending on the type of material chosen as a design choice. Typical hole blocking layer materials include, for example, trimethoxysilyl propylene diamine, hydrolyzed trimethoxysilyl propyl ethylene diamine, N-β-(aminoethyl)-γ-aminopropyl trimethoxy silane, isopropyl 4-aminobenzene sulfonyl di(dodecylbenzene sulfonyl)titanate, isopropyl di(4-aminobenzoyl) isostearoyl titanate, isopropyl tri(N-ethylaminoethylamino) titanate, isopropyl trianthranil titanate, isopropyl tri(N,N-dimethylethylamino)titanate, titanium-4-amino benzene sulfonate oxyacetate, titanium 4-aminobenzoate isostearate oxyacetate, (γ-aminobutyl)methyl diethoxysilane, (γ-aminopropyl)methyl diethoxysilane and combinations thereof, as disclosed, for example, in U.S. Pat. Nos. 4,338,387; 4,286,033; 4,988,597; 5,244,762; and 4,291,110, each incorporated herein by reference in entirety.

The blocking layer may be applied by any suitable conventional technique, such as, spraying, dip coating, draw bar coating, gravure coating, silk screening, air knife coating, reverse roll coating, vacuum deposition, chemical treatment and the like. For convenience in obtaining thin layers, the blocking layer may be applied in the form of a dilute solution, with the solvent being removed after deposition of the coating by conventional techniques, such as, vacuum, heating and the like. A weight ratio of blocking layer material and solvent of between about 0.05:100 to about 5:100 can be used for spray coating. Such deposition methods for forming layers can be used for making any of the herein described layers.

The Adhesive Interface Layer

An optional adhesive interface layer may be employed. An interface layer may be situated, for example, intermediate between the hole blocking layer and the CGL. The interface layer may include a film-forming material, such as, a polyurethane, a polyester and so on. An example of a polyester includes a polyarylate, a polyvinylbutyral and the like.

Any suitable solvent or solvent mixture may be employed to form an adhesive interface layer coating solution. Typical solvents include tetrahydrofuran, toluene, monochlorobenzene, methylene chloride, cyclohexanone and the like, as well as mixtures thereof. Any suitable and conventional technique may be used to mix and thereafter to apply the adhesive interface layer coating mixture to the photoreceptor under construction as taught herein or as known in the art. Typical application techniques include spraying, dip coating, roll coating, wire wound rod coating and the like. Drying of the deposited wet coating may be accomplished by any suitable conventional process, such as oven drying, infrared drying, air drying and the like.

The adhesive interface layer may have a thickness of from about 0.01 μm to about 900 μm after drying. In certain embodiments, the dried thickness is from about 0.03 μm to about 1 μm.

The Charge Generating Layer

The CGL can comprise any suitable charge generating binder or film-forming material including a charge generating/photoconductive material suspended or dissolved therein, which may be in the form of particles and dispersed in a film-forming material or binder, such as an electrically inactive resin. Examples of charge generating materials include, for example, inorganic photoconductive materials, such as, azo materials, such as, certain dyes, such as, Sudan Red and Diane Blue, quinone pigments, cyanine pigments and so on, amorphous selenium, trigonal selenium and selenium alloys, such as, selenium-tellurium, selenium-tellurium-arsenic, selenium arsenide and mixtures thereof, germanium and organic photoconductive materials, including various phthalocyanine pigments, such as, the X form of metal-free phthalocyanine, metal phthalocyanines, such as, vanadyl phthalocyanine and copper phthalocyanine, hydroxygallium phthalocyanines, chlorogallium phthalocyanines, titanyl phthalocyanines, quinacridones, dibromo anthanthrone pigments, benzimidazole perylene, substituted 2,4-diaminotriazines, polynuclear aromatic quinones and the like dispersed or suspended in a film-forming material, such as, a polymer, or a binder. Selenium, selenium alloy and the like and mixtures thereof may be formed as a homogeneous CGL. Benzimidazole perylene compositions are described, for example, in U.S. Pat. No. 4,587,189, the entire disclosure thereof being incorporated herein by reference. Multicharge generating layer compositions may be utilized where a photoconductive layer enhances or reduces the properties of the CGL. The charge generating materials can be sensitive to activating radiation having a wavelength from about 400 nm to about 900 nm during the imagewise radiation exposure step forming an electrostatic latent image. For example, hydroxygallium phthalocyanine absorbs light of a wavelength of from about 370 nm to about 950 nm, as disclosed, for example, in U.S. Pat. No. 5,756,245.

Any suitable film-forming material may be employed in a CGL, including those described, for example, in U.S. Pat. No. 3,121,006, the entire disclosure thereof being incorporated herein by reference, or as taught herein. Typical film-forming materials include thermoplastic and thermosetting resins, such as a polycarbonate, a polyester, a polyamide, a polyurethane, a polystyrene, a polyarylether, a polyarylsulfone, a polybutadiene, a polysulfone, a polyethersulfone, a polyethylene, a polypropylene, a polyimide, a polymethylpentene, a polyphenylenesulfide, a polyvinylbutyral, a polyvinyl acetate, a polysiloxane, a polyacrylate, a polyvinylacetal, an amino resin, a phenyleneoxide resin, a terephthalic acid resin, an epoxy resin, a phenolic resin, an acrylonitrile copolymer, a polyvinylchloride, a vinylchloride, a vinyl acetate copolymer, an acrylate copolymer, an alkyd resin, a cellulosic film former, a poly(amideimide), a styrene-butadiene copolymer, a vinylidenechloride/vinylchloride copolymer, a vinylacetate/vinylidene chloride copolymer, a styrene-alkyd resin and the like. Another film-forming material is PCZ-400 (poly (4,4'-dihydroxy-diphenyl-1-1-cyclohexane) with a viscosity/molecular weight of about 40,000. A copolymer can be a block or a graft, random or alternating, and so on. The materials, polymers and copolymers mentioned herein can be used in any of the layers taught herein.

The charge generating material can be present in the film-forming material or binder composition in various amounts. Generally, from about 5% by weight or volume to about 90% by weight or volume of the charge generating material is dispersed in about 10% by weight or volume to about 95% by weight or volume of the film-forming material or binder, or from about 20% by volume to about 60% by volume of the charge generating material is dispersed in about 40% by volume to about 80% by volume of the film-forming material or binder composition.

The CGL containing the charge generating material and the binder or film-forming material generally ranges in thickness from about 0.1 μm to about 5 μm, for example, or from about 0.3 μm to about 3 μm when dry. The CGL thickness can be related to film or binder content, higher film or binder content compositions generally employ thicker layers for charge generation.

In some embodiments, the CGL may comprise a charge transport molecule or component, as discussed below in regard to the CTL. The charge transport molecule may be present in some embodiments from about 1% to about 60% by weight of the total weight of the CGL.

The Charge Transport Layer

The CTL generally is superior or exterior to the CGL and may include any suitable film-forming material, such as, a transparent organic polymer or non-polymeric material capable of supporting the injection of photogenerated holes or electrons from the CGL and capable of allowing the transport of the holes/electrons through the CTL to selectively discharge the charge on the surface of the imaging device component, such as, a photoreceptor. The CTL can be a substantially non-photoconductive material, but one which supports the injection of photogenerated holes from the CGL. The CTL is normally transparent in a wavelength region in which the electrophotographic imaging device component is to be used when exposure is effected therethrough to ensure that most of the incident radiation is utilized by the underlying CGL. Thus, the CTL exhibits optical transparency with negligible light absorption and negligible charge generation when exposed to a wavelength of light useful in xerography, e.g., from about 400 nm to about 900 nm. In the case when the imaging device component is prepared with transparent materials, imagewise exposure or erase may be accomplished through the substrate with all light passing through the back side of the substrate. In that case, the materials of the CTL need not transmit light in the wavelength region of use if the CGL is sandwiched between the substrate and the CTL.

In one embodiment, the CTL not only serves to transport holes, but also to protect the CGL from abrasion or chemical attack and may therefore extend the service life of the imaging device component. That latter goal is achieved herein by incorporating a spirodilactam into the CTL, said spirodilactam can be incorporated in a copolymer with another monomer, such as a carbonate, such as, a bisphenol A, that is used in a CTL.

The CTL may include any suitable charge transport molecule or activating compound useful as an additive molecularly dispersed in an electrically inactive polymeric film-forming material or binder to form a solution and thereby making the material electrically active. The charge transport molecule may be added to a film-forming polymeric material, a film-forming material or binder which is otherwise incapable of supporting the injection of photogenerated holes from the charge generation material and incapable of allowing the transport of the holes therethrough. The charge transport molecule typically comprises small molecules of an organic compound which cooperate to transport charge between molecules and ultimately to the surface of the CTL, for example, see U.S. Pat. Nos. 7,759,032 and 7,704,658.

For example, N,N'-diphenyl-N,N'-bis(3-methylphenyl)-(1,1'-biphenyl)-4,4' diamine can be used as a charge transport molecule. Other charge transport molecules include pyrazolines, diamines, hydrazones, oxadiazoles, stilbenes, carbazoles, oxazoles, triazoles, imidazoles, imidazolones, imidazolidines, bisimidazolidines, styryls, oxazolones, benzimidazoles, quinalolines, benzofurans, acridines, phenazines, aminostilbenes, aromatic polyamines, such as aryl diamines and aryl triamines, such as, aromatic diamines, including, N,N'-diphenyl-N,N'-bis(alkylphenyl)-1,1'-biphenyl-4,4-diamines; N,N'-diphenyl-N,N'-bis[3-methylphenyl]-[1,1'-biphenyl]-4,4'-diamines; N,N'-diphenyl-N,N'-bis(chlorophenyl)-1,1'-biphenyl-4,4'-diamines; N,N'-bis-(4-methylphenyl)-N,N'-bis(4-ethylphenyl)-1,1'-3,3'-dimethylbiphenyl)-4,4'-diamines, N,N'-bis-(3,4-dimethylphenyl)-4,4'-biphenyl amines; and combinations thereof. Other suitable charge transport molecules include pyrazolines, such as, 1-[lepidyl-(2)]-3-(p-diethylaminophenyl)-5-(p-diethylaminophenyl)pyrazoline, as described, for example, in U.S. Pat. Nos. 4,315,982, 4,278,746, 3,837,851, and 6,214,514; substituted fluorene charge transport molecules, such as, 9-(4'-dimethylaminobenzylidene)fluorene, as described in U.S. Pat. Nos. 4,245,021 and 6,214,514; oxadiazole transport molecules, such as 2,5-bis(4-diethylaminophenyl)-1,3,4-oxadiazole, pyrazolines, imidazoles and triazoles, as described, for example, in U.S. Pat. No. 3,895,944; hydrazones, such as p-diethylaminobenzaldehyde (diphenylhydrazone), as described, for example, in U.S. Pat. Nos. 4,150,987, 4,256,821, 4,297,426, 4,338,388, 4,385,106, 4,387,147, 4,399,207, 4,399,208 and 6,124,514; and tri-substituted methanes, such as, alkyl-bis(N,N-dialkylaminoaryl) methanes, as described, for example, in U.S. Pat. No. 3,820,989. The disclosure of each of those patents is incorporated herein by reference in entirety.

The charge transport molecule may be present in some embodiments from about 1% to about 70% by weight of the total weight of the CTL or in other embodiments from about 10% to about 70% by weight of the total weight of the CTL, or from about 20% to about 70%; from about 30% to about 70%; or from about 40% to about 70% of the total weight of the CTL.

Any suitable electrically inactive film-forming material or binder may be used to form the CTL. Typical inactive film-forming materials or binders include, a polycarbonate resin, a polystyrene, a polyester, a polyarylate, a polyacrylate, a polyether, a polyethylene, which may be substituted, for example, with a hydrocarbon or a halogen, a polysulfone, a fluorocarbon, a thermoplastic polymer and the like. Molecular weights can vary, for example, from about 20,000 to about 150,000. Examples of film-forming materials or binders include a polycarbonate, such as, poly(4,4'-isopropylidene-diphenylene)carbonate (also referred to as bisphenol-A-polycarbonate or PCA), poly(4,4'-cyclohexylidine-diphenylene)carbonate (referred to as bisphenol-Z-polycarbonate or PCZ), poly(4,4'-isopropylidene-3,3'-dimethyl-diphenyl)carbonate (also referred to as bisphenol-C-polycarbonate or PCC) and the like and mixtures thereof.

Lubricating agents can be included in a CTL. Suitable lubricants include a polyether (for example, see U.S. Pat. No. 7,427,440); one with antioxidizing activity, as taught, for example, in U.S. Pat. No. 7,544,451; a phosphorus-containing compound, such as phosphite or a phosphoric acid amine salt, for example, as provided in U.S. Pat. No. 7,651,827; a synthetic hydrocarbon; a polyolefin; a polyolester; a thiocarbonate; a fluorinated resin, such as, a polytetrafluoroethylene (PTFE); copolymers of a fluorinated resin, such as, a copolymer of tetrafluoroethylene and hexafluoropropylene, a copolymer of tetrafluoroethylene and perfluoro(propyl vinyl ether), a copolymer of tetrafluoroethylene and perfluoro(ethyl vinyl ether), a copolymer of tetrafluoroethylene and perfluoro(methyl vinyl ether), a copolymer of tetrafluoroethylene, hexafluoropropylene and vinylidene fluoride, mixtures thereof, and the like, inclusive of a number of suitable known fluorinated polymers; a lamellar solid; a polyethylene; a polypropylene and so on, for example, as provided, for example, in U.S. Pat. Nos. 7,527,902 and 7,468,208.

Crosslinking agents can be used to promote polymerization of the polymer or film-forming material of a CTL. Examples of suitable crosslinking agents include an acrylated polystyrene, a methacrylated polystyrene, an ethylene glycol dimethacrylate, a bisphenol A glycerolate dimethacrylate, a (dimethylvinylsilyloxy)heptacyclopentyltricyclohep-tasiloxanediol and the like and mixtures thereof. The crosslinking agent can be used in an amount of from about 1% to about 20%, or from about 5% to about 10%, or from about 6% to about 9% by weight or volume of total polymer or film-forming material content.

The CTL can contain variable amounts of an antioxidant, such as a hindered phenol. An example of a hindered phenol is octadecyl-3,5-di-tert-butyl-4-hydroxyhydrociannamate. The hindered phenol may be present in an amount up to about 10 weight % based on the concentration or amount of the charge transport molecule. Other suitable antioxidants are described, for example, in U.S. Pat. No. 7,018,756, incorporated herein by reference in entirety.

The surprising durability of a CTL of interest arises from incorporating a lubricant and/or a spirodilactam in a film-forming or binder composition. In some embodiments, a spirodilactam is provided as a copolymer, wherein the second monomer can be, for example, a carbonate.

A CTL of interest comprising a spirodilactam has increased wear resistance in an imaging device. Hence, where a control photoreceptor with a CTL lacking a spirodilactam may experience a wear rate of about 50 nm/kcycle, a photoreceptor of interest comprising a CTL comprising a lubricant and/or a spirodilactam has a wear rate of about 35 nm/kcycle or less, that is, has a wear rate of about 30 nm/kcycle or less, of about 25 nm/kcycle and so on, or a wear rate of about 20 nm/kcycle or less, that is, has a wear rate of about 18 nm/kcycle, of about 16 nm/kcycle, of about 14 nm/kcycle and so on.

Suitable spirodilactams that can be used in a CTL of interest include those disclosed in U.S. Pat. Nos. 4,939,251; 4,940,801; 4,963,691; 5,093,499; and 5,103,001 of Shell Oil Co., Houston, Tex. Hence, a spirodilactam of interest can have the following basic formula:

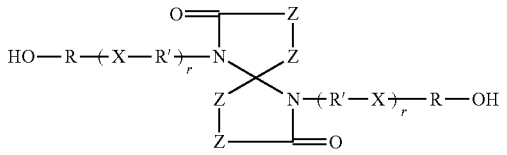

The free carbons on each lactam ring can be substituted. For example, Z independently can be $>C(Z')_2$ in which Z' independently is hydrogen, lower alkyl of up to 4 carbon atoms, preferably methyl, halogen, preferably the lower halogens, such as, fluorine or chlorine, or aryl, preferably phenyl; or two adjacent Z groups together can form a ring, Z", for example, of from 5 to 7 ring atoms, wherein up to two of which can be heteroatoms selected from nitrogen, oxygen or sulfur with the remaining ring atoms being carbon atoms, there being up to 15 carbon atoms inclusive in each Z", two of which can form a bridge between the carbon atoms connected by the two adjacent Z groups. The nitrogen atoms also can be substituted. For example, R independently is aromatic of up to 15 carbon atoms and up to 2 aromatic rings, inclusive; R' independently is R or aliphatic of up to 10 carbon atoms inclusive; r independently is 0 or 1; and X independently is a direct valence bond, alkylene of up to 8 carbon atoms inclusive, oxy, thio, sulfonyl, carbonyl, dioxyphenylene, 2,2-di(oxyphenyl) propane, di(oxyphenyl) sulfone or dioxydiphenylene. Each of R and R' is hydrocarbyl containing only atoms of carbon and hydrogen or are substituted hydrocarbons containing additional atoms in the form of inert carbon atom substituents such as halogen, particularly the middle halogens chloro or bromo. In some embodiments, the spirodilactam is one comprising lactam moieties each carrying a fused benzene ring, that is, referring to the above structure, Z" is a fused ring of 6 carbon atoms. In other embodiments, the lactam nitrogen is attached to a phenol group. That is, in the above structure, r is 0 and R is a 6 carbon aromatic. Hence, one species of spirodilactam that can be used has the structure:

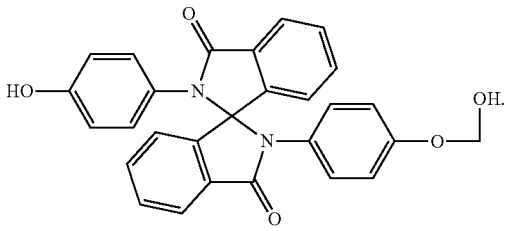

Suitable copolymers that can be used in a CTL of interest include those that comprise, for example, a carbonate monomer, such as, one comprising a polycyclic phenol, such as, a bisphenol. Hence, suitable reactants to form a copolymer of interest are dicarboxylic acids, dicarboxylic acid halides and so on. In such molecules, any of a variety of molecular groups can be found between the two carboxylic acid groups. Examples of suitable spirodilactam/carbonate copolymers and methods for making same are provided in U.S. Pat. Nos. 4,906,725; 4,939,251; 4,968,768; 4,906,725; 5,030,707; 5,053,518; and 5,095,088, of Shell Oil Co., Houston, Tex.

In some embodiments, the carbonate monomer is one which is composed of one or more aryl groups. An example of such an aryl group is a bisphenol. Hence, a bisphenol compound can be polymerized into a polycarbonate by reacting same with base, such as, sodium hydroxide, and phosgene, as known in the art.

Examples of bisphenol monomers that can be used in a copolymer of interest include bisphenol A, bisphenol B, bisphenol C, bisphenol F, bisphenol S, bisphenol Z and so on.

Specific examples of a spirodilactam-containing copolymer are:

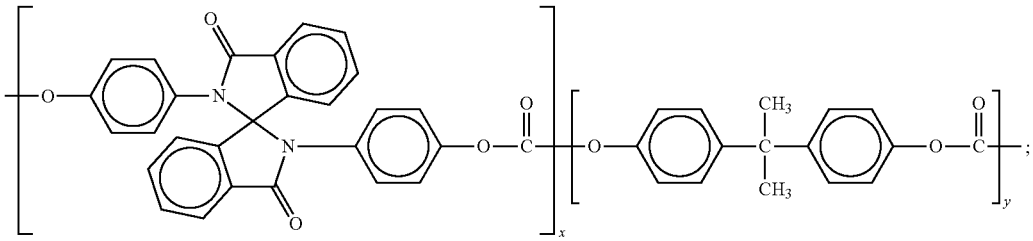

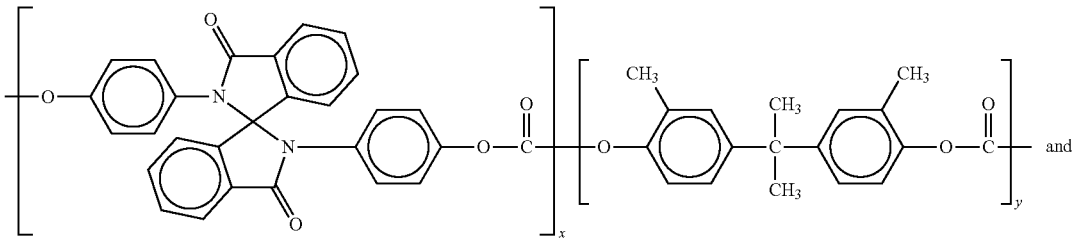

-continued

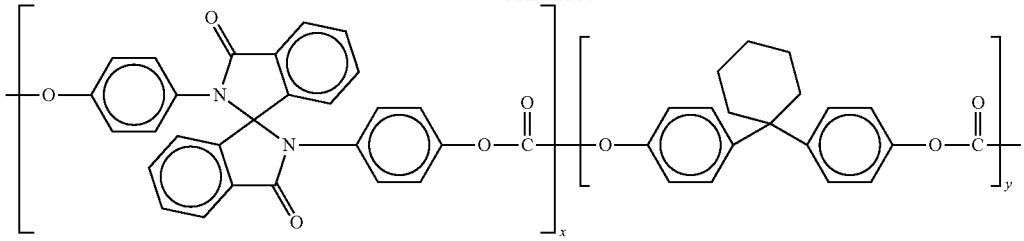

wherein x and y each represent mole percent, x is from about 1 mole % to about 30 mole %, or from about 1 mole % to about 20 mole %, or from about 1 mole % to about 10 mole %; y is from about 70 mole % to about 99 mole %, or from about 80 mole % to about 99 mole %, or from about 90 mole % to about 99 mole %; and where the sum of x and y is 100 mole percent.

In a copolymer of interest, the spirodilactam monomer is present at an amount of 1% to about 30% of the copolymer with the remainder comprising the other monomer. Hence, the spirodilactam monomer can be present in an amount of 1% to about 20%; from 1% to about 10%; and so on of the copolymer. Thus, for example, a copolymer can comprise from about 2% to about 9%; from about 3% to about 8%; from about 4% to about 7% of the spirodilactam monomer, where % is mole percent.

A copolymer of interest has a $T_g$ of 180° C. or more; of 190° C. or more; of 200° C. or more; of 210° C. or more; of 220° C. or more and so on.

The average molecular weight of a copolymer of interest can be about 10 k MW, about 20 k MW, about 30 k MW, about 40 k MW, about 50 k MW, about 60 k MW, about 70 k MW, about 80 k MW, about 90 k MW, about 100 k MW, about 110 k MW, about 120 k MW or more.

A CTL of interest can comprise a film-forming material; a charge transport material; a lubricant; and a spirodilactam. The lubricant, preferably a fluorinated resin, such as a polytetrafluoroethylene (PTFE) or a copolymer of a fluorinated resin, such as, tetrafluoroethylene and hexafluoropropylene; a copolymer of tetrafluoroethylene and perfluoro(propyl vinyl ether); a copolymer of tetrafluoroethylene and perfluoro(ethyl vinyl ether); a copolymer of tetrafluoroethylene and perfluoro(methyl vinyl ether); a copolymer of tetrafluoroethylene, hexafluoropropylene and vinylidene fluoride, mixtures thereof, and the like, inclusive of a number of suitable known fluorinated polymers, can be present in an amount, relative to the total, from about 1% to about 15%; from about 3% to about 10%; or about 8% or about 9% in a CTL of interest. The spirodilactam can be present in an amount, relative to the total, from about 1% to about 15%; from about 2% to about 14%; from about 3% to about 13%; from about 4% to about 12%; or from about 5% to about 11% of a CTL of interest. The charge transport material can be present from about 20% to about 50% of the CTL; from about 25% to about 45%; from about 30% to about 40%; or about 35% in a CTL of interest. The remainder comprises a film-forming material. (The above amounts and percentages, including those presented elsewhere in the specification, are in terms of and relative to w/v, w/w or v/w as appropriate for the material(s).)

Any suitable and conventional technique may be used to mix and thereafter to apply the CTL coating mixture to the photoreceptor under construction. Typical application techniques include spraying, dip coating, roll coating, wire wound rod coating and the like. Drying of the deposited coating may be obtained by any suitable conventional technique such as oven drying, infrared drying, air drying and the like.

The CTL can be an insulator to the extent that the electrostatic charge placed on the CTL is not conducted in the absence of illumination at a rate sufficient to prevent formation and retention of an electrostatic latent image thereon. In general, the ratio of the thickness of the CTL to the CGL is from about 2:1 to about 200:1 and in some instances as great as about 400:1.

The thickness of the CTL can be from about 5 μm to about 200 μm, or from about 15 μm to about 40 μm. The CTL may comprise dual layers or plural layers, and each layer may contain different concentrations of a charge transporting component or may contain different charge transporting components.

The Ground Strip Layer

Another possible layer is a ground strip layer, including, for example, conductive particles dispersed in a film-forming material or binder, which may be applied to one edge of the imaging device component to promote electrical continuity, for example, with the conductive layer or the substrate. The ground strip layer may include any suitable film-forming material, polymer or binder and electrically conductive particles as taught herein. Typical ground strip materials include those enumerated in U.S. Pat. No. 4,664,995, the entire disclosure of which is incorporated by reference herein.

The Overcoat Layer

An overcoat layer also may be used to provide imaging device component surface protection, improved cleanability, reduced friction as well as improved resistance to abrasion.

An overcoat layer can include at least a film-forming material or binder, such as, a resin, and optionally, can include a hole transporting molecule, such as, a terphenyl diamine hole transporting molecule. The overcoating layer can be formed, for example, from a solution or other suitable mixture of the film-forming material or binder, such as, a resin.

The film-forming material or binder, such as, a resin, used in forming the overcoating layer can be any suitable film-forming material or binder, such as, a resin, including any of those described herein. The film-forming material or binder, such as, a resin, can be electrically insulating, semi-conductive or conductive, and can be hole transporting or not hole transporting. Thus, for example, suitable film-forming materials or binders, such as, resins, can be selected from, but are not limited to, thermoplastic and thermosetting resins, such as, polycarbonates, polyesters, polyamides, polyurethanes, polystyrenes, polyarylethers, polyarylsulfones, polysulfones, polyethersulfones, polyphenylene sulfides, polyvinyl acetate, polyacrylates, polyvinyl acetals, polyamides, polyimides, amino resins, phenylene oxide resins, phenoxy resins, epoxy resins, phenolic resins, polystyrenes, acrylonitriles, copolymers, vinyl acetate copolymers, acrylate copolymers, alkyd resins, styrenebutadiene copolymers, styrene-alkyd resins, polyvinylcarbazole and the like. A copolymer may be block, graft, random or alternating.

In some embodiments, the film-forming material or binder, such as, a resin, can be a polyester polyol, such as, a branched polyester polyol. The prepolymer is synthesized using a significant amount of a polyfunctional monomer, such as, trifunctional alcohols, such as triols, to form a polymer having a significant number of branches off the main polymer chain. That is distinguished from a linear prepolymer that contains only difunctional monomers, and thus little or no branches off the main polymer chain. As used herein, "polyester polyol" is meant to encompass such compounds that include multiple ester groups as well as multiple alcohol (hydroxyl) groups in the molecule, and which can include other groups, such as, for example, ether groups, amino groups, sulfhydryl groups and the like.

Examples of such suitable polyester polyols include, for example, polyester polyols formed from the reaction of a polycarboxylic acid, such as, a dicarboxylic acid or a tricarboxylic acid (including acid anhydrides) with a polyol, such as, a diol or a triol. The number of ester and alcohol groups, and the relative amount and type of a polyacid and a polyol, are selected such that the resulting polyester polyol compound retains a number of free hydroxyl groups, which can be used for subsequent crosslinking or derivatization in forming the overcoat film-forming material or binder material. For example, suitable polycarboxylic acids include, but are not limited to, adipic acid, pimelic acid, suberic acid, azelaic acid, sebasic acid and the like. Suitable polyols include, but are not limited to, difunctional materials, such as glycols or trifunctional alcohols, such as, triols and the like, including propanediols, butanediols, hexanediols, glycerine, 1,2,6-hexane triol and the like. Reference is made to U.S. Pub. No. 2009/0130575.

In forming the film-forming material or binder for the overcoating layer in embodiments where the film-forming material or binder is a polyester polyol, a polyol, or a combination thereof, any suitable crosslinking agent, a catalyst and the like can be included in known amounts for known purposes. For example, a crosslinking agent or an accelerator, such as a melamine crosslinking agent or an accelerator, can be included with a polyester polyol reagent to form an overcoating layer. Incorporation of a crosslinking agent or accelerator provides reaction sites to interact with the polyester polyol to provide a branched, crosslinked structure. When so incorporated, any suitable crosslinking agent or accelerator can be used, including, for example, trioxane, melamine compounds and mixtures thereof. Where melamine compounds are used, they can be suitably functionalized to be, for example, melamine formaldehyde, methoxymethylated melamine compounds, such as glycouril formaldehyde, benzoguanamine formaldehyde and the like.

Crosslinking is generally accomplished by heating in the presence of a catalyst. Thus, the solution of the polyester polyol can also include a suitable catalyst. Typical catalysts include, for example, oxalic acid, maleic acid, carbollylic acid, ascorbic acid, malonic acid, succinic acid, tartaric acid, citric acid, p-toluenesulfonic acid, methanesulfonic acid and the like and mixtures thereof.

If desired or necessary, a blocking agent also can be included. A blocking agent can be used to "tie up" or block an acid effect to provide solution stability until an acidic catalyst function is desired. Thus, for example, the blocking agent can block an acid effect until the solution temperature is raised above a threshold temperature. For example, some blocking agents can be used to block an acid effect until the solution temperature is raised above about 100° C. At that time, the blocking agent dissociates from the acid and vaporizes. The unassociated acid is then free to catalyze polymerization. Examples of such suitable blocking agents include, but are not limited to, pyridine and commercial acid solutions containing such blocking agents.

Any suitable alcohol solvent may be employed for the film-forming material. Typical alcohol solvents include, for example, butanol, propanol, methanol, 1-methoxy-2-propanol and the like and mixtures thereof. Other suitable solvents that can be used in forming the overcoating layer solution include, for example, tetrahydrofuran, monochlorobenzene and mixtures thereof. The solvents can be used in addition to, or in place of, the above alcohol solvents.

A suitable hole transport material may be utilized in the overcoat layer to improve charge transport mobility of the layer. The hole transport material can be, for example, a terphenyl hole transporting molecule, such as, a terphenyl diamine hole transporting molecule. In some embodiments, the hole transporting molecule is soluble in alcohol to assist in application along with the polymer or film-forming material or binder in solution form. However, alcohol solubility is not required and the combined hole transporting molecule and film-forming material or binder can be applied by methods other than in solution, as needed.

An overcoat may comprise a dispersion of nanoparticles, such as silica, metal oxides, waxy polyethylene particles, polytetrafluoroethylene (PTFE) and the like. The nanoparticles may be used to enhance lubricity, scratch resistance and wear resistance of an overcoat layer. In some embodiments, the nanoparticles are comprised of nanopolymeric gel particles of crosslinked polystyrene-n-butyl acrylate dispersed or embedded in a film-forming material, binder or polymer matrix.

In some embodiments, an overcoat layer may comprise a charge transport molecule or component. The charge transport molecule may be present in some embodiments in an amount from about 1% to about 60% by weight of the total weight of an overcoat layer.

The thickness of the overcoat layer can depend on the abrasiveness of the charging (e.g., bias charging roll), cleaning (e.g., blade or web), development (e.g., brush), transfer (e.g., bias transfer roll) etc. functions in the imaging device employed and can range from about 1 μm or about 2 μm to about 10 μm or about 15 μm or more. A thickness of between about 1 μm and about 5 μm can be used. Typical application techniques include spraying, dip coating, roll coating, extrusion coating, draw bar coating, wire wound rod coating and the like. The overcoat can be formed as a single layer or as multiple layers. Drying of the deposited coating may be obtained by any suitable conventional technique such as oven drying, infrared radiation drying, air drying and the like. The dried overcoating can transport holes during imaging. An overcoat may not have a high free carrier concentration as free carrier concentration can increase dark decay. The dark decay of an overcoat can be about the same as that of the unovercoated device.

In the dried overcoating layer, the composition can include from about 40% to about 90% by weight of film-forming material or binder, and from about 60% to about 10% percent by weight of other ingredients.

The basic film-forming materials and other non-photoactive components for constructing a layer, as well as the methods for making, applying and setting the layer on a photoreceptor under construction as described herein can be used for making the other layers taught herein.

The Anti-Curl Back Coating Layer

An anti-curl back coating may be applied to the surface of a substrate opposite to that bearing the photoconductive layer(s) to provide flatness and/or abrasion resistance, such as, when a web configuration imaging device component is contemplated. The anti-curl back coating layer is known and can comprise a film-forming material or binder, such as, thermoplastic organic polymers or inorganic polymers, that are electrically insulating or slightly semiconductive. The thickness of anti-curl back coating layers generally is sufficient to balance substantially the total forces of the layer or layers on the opposite side of a substrate. An example of an anti-curl back coating layer is described in U.S. Pat. No. 4,654,284, the disclosure of which is incorporated herein by reference in entirety. A thickness of from about 70 μm to about 160 μm can be used for a flexible device imaging component, although the thickness can be outside that range as a design choice.

Because conventional anti-curl back coating formulations can suffer from electrostatic charge build up due to contact friction between the anti-curl layer and, for example, backer bars, which can increase friction and wear, incorporation of compounds to dissipate charge, such as, nanopolymeric gel particles, into the anti-curl back coating layer can substantially eliminate charge build up. In addition to reducing electrostatic charge build up and reducing wear in the layer, a charge dissipating material, such as, nanopolymeric gel particles, may be used to enhance lubricity, scratch resistance and wear resistance of the anti-curl back coating layer. In some embodiments, the nanopolymeric gel particles are comprised of crosslinked polystyrene-n-butyl acrylate, which are dispersed or embedded in a film-forming material or binder, such as, a polymer or a matrix.

In some embodiments, the anti-curl back coating layer may comprise a charge transport molecule or component. The charge transport molecule may be present from about 1% to about 60% by weight of the total weight of the anti-curl back coating layer.

The Undercoat

An undercoat may be present, and can be composed of a binder or a film-forming material or substance, such as, a resin, a casein, a phenolic resin, a polyol, such as an acrylic polyol, an aminoplast resin, a polyvinyl alcohol, a nitrocellulose, an ethylene-acrylic acid copolymer, a polyamide, a polyurethane or a gelatin can be used, and the layer formed, for example, by dip coating. Examples of polyol resins include, but are not limited to, a polyglycol, a polyglycerol and mixtures thereof. The aminoplast resin can be, but is not limited to, urea, melamine and mixtures thereof.

In various embodiments, phenolic resins can be considered condensation products of an aldehyde and a phenol compound in the presence of an acidic or basic catalyst. The phenol compound may be, for example, phenol, alkyl-substituted phenols, such as, cresols and xylenols, halogen-substituted phenols, such as, chlorophenol, polyhydric phenols, such as, resorcinol or pyrocatechol, polycyclic phenols, such as, naphthol and bisphenol A, aryl-substituted phenols, cycloalkyl-substituted phenols, aryloxy-substituted phenols and combinations thereof. The phenol compound may be for example, 2,6-xylenol, o-cresol, p-cresol, 3,5-xylenol, 3,4-xylenol, 2,3,4-trimethyl phenol, 3-ethyl phenol, 3,5-diethyl phenol, p-butyl phenol, 3,5-dibutyl phenol, p-amyl phenol, p-cyclohexyl phenol, p-octyl phenol, 3,5-dicyclohexyl phenol, p-phenyl phenol, p-crotyl phenol, 3,5-dimethoxy phenol, 3,4,5-trimethoxy phenol, p-ethoxy phenol, p-butoxy phenol, 3-methyl-4-methoxy phenol, p-phenoxy phenol, multiple ring phenols and combinations thereof. The aldehyde may be, for example, formaldehyde, paraformaldehyde, acetaldehyde, butyraldehyde, paraldehyde, glyoxal, furfuraldehyde, propinonaldehyde, benzaldehyde and combinations thereof. The phenolic resin may be, for example, selected from dicyclopentadiene-type phenolic resins, phenol novolak resins, cresol novolak resins, phenol aralkyl resins and combinations thereof, see U.S. Pat. Nos. 6,255,027, 6,155,468, 6,177,219 and 6,156,468, each incorporated herein by reference in entirety. Examples of phenolic resins include, but are not limited to, formaldehyde polymers with p-tert-butylphenol, phenol and cresol; formaldehyde polymers with ammonia, cresol and phenol; formaldehyde polymers with 4,4'-(1-methylethylidene)bisphenol; formaldehyde polymers with cresol and phenol; or formaldehyde polymers with p-tert-butylphenol and phenol.

Phenolic resins are commercially available and can be used as purchased or can be modified to enhance certain properties. For example, the phenolic resins can be modified with suitable plasticizers, including, but not limited to, a polyvinyl butyral, a polyvinyl formal, an alkyd, an epoxy resin, a phenoxy resin (bisphenol A or epichlorohydrin polymer), a polyamide, an oil and the like.

Various types of fine particles and metallic oxides can be added to adjust the resistance of the undercoat layer. Examples of such metallic oxides include alumina, zinc oxide, aluminum oxide, silicon oxide, zirconium oxide, molybdenum oxide, titanium oxide, tin oxide, antimony oxide, indium oxide and bismuth oxide. Examples also include extra fine particles of tin-doped indium oxide, antimony-doped tin oxide and antimony-doped zirconium oxide. A single species of a metallic oxide can be used or two or more types can be used in combination. When two or more are used, the plural oxides can be used in the form of a solution or a fused substance. The average particle size of a metallic oxide can be about 0.3 μm or less, or about 0.1 μm or less. In some embodiments, metallic oxide particles can be surface treated. Surface treatments include, but are not limited to, exposure of the particles to aluminum laurate, alumina, zirconia, silica, silane, methicone, dimethicone, sodium metaphosphate and the like and mixtures thereof.

The solvent used for preparing the undercoat, depending on the presence of additives therein, is one capable of, for example, effective dispersion of inorganic particles and dissolution of the film-forming material or substance. A suitable solvent can be an alcohol, such as those containing 1, 2, 3, 4, 5 or 6 carbons, such as, ethanol, n-propyl alcohol, isopropyl alcohol, n-butanol, t-butanol and sec-butanol. Further, to improve storage ability and particle dispersion, it is possible to use an auxiliary solvent. Examples of such an auxiliary solvent are methanol, benzyl alcohol, toluene, methylene chloride, cyclohexane and tetrahydrofuran.

When particles are dispersed in a binder, resin or film-forming material or substance to prepare an undercoat, the particles can be present in an amount of about 20 wt % to about 80 wt %; from about 30 wt % to about 70 wt %; from about 40 wt % to about 60 wt %; or from about 50 wt % to about 60 wt % of the total weight of undercoat materials.

An ultrasonic homogenizer, ball mill, sand grinder or homomixer can be used to disperse the inorganic particles.

The method of drying the undercoat can be selected as appropriate in conformity with the type of solvent and film thickness. For example, drying by heat can be used.

The film thickness of the undercoat layer can be about 0.1 μm to about 30 μm, or from about 1 μm to about 20 μm, or from about 4 μm to about 15 μm.

Thus, a CTL of interest is one which does not impact negatively any of the functions normally ascribed to a CTL and does not impact negatively the overall function of a photoreceptor, however, provides enhanced wear resistance, thereby extending the life of a photoreceptor. Thus, the electrical properties of a photoconductor or photoreceptor of interest, as evidenced, for example, by PIDC's, are comparable to that of a control photoreceptor not containing or lacking a lubricant and/or a spirodilactam-doped CTL; and print quality, when in an imaging device, is comparable to that of a control imaging device comprising a photoreceptor lacking a lubricant and/or a spirodilactam-doped CTL, as evidenced, for example, by ghosting studies. When compared to a control, a photoreceptor of interest presents with a wear rate at least about 40% less than control, at least about 50% less than control, at least about 60% less than control, or at least about 70% less than control or more, where a control is a photoreceptor lacking a lubricant and/or a spirodilactam in the CTL, where the wear rate is determined practicing materials and methods known in the art. For example, a test device comprising a bias charge roll (BCR) associated with a photoreceptor can be used. The BCR can be variably charged. The thickness of the coating on a photoreceptor can be determined with a device dedicated to assessing coating thickness, such as those available from Helmut Fischer GmbH, such as, the FISCHERSCOPE™ device. The photoreceptor then is tested in the device for a predetermined number of cycles and the coating thickness is measured and compared to the thickness prior to testing. The wear rate can be determined buy dividing the difference in coating thickness by the number of cycles.

A CTL of interest is used in a photoreceptor as provided herein. Then, the remaining layers to yield a functional photoreceptor are added to a substrate, at least a CGL, as taught herein or as known in the art. A CTL of interest can be used with any organic photoreceptor independent of the specific substrate, CGL and of the specific other layers that comprise a photoreceptor. The completed photoreceptor comprising a spirodilactam-doped CTL is engaged in an imaging device as known in the art to enable the production of an image product, for example, photocopies. Hence, such an imaging device can comprise a device for producing and removing an imagewise charge on the photoreceptor. The imaging device can contain a developing component for applying a developing composition, such as a finely divided pigmented material to said charge retentive surface of said photoreceptor to yield the image on the surface of said photoreceptor. Such an imaging device also may include an optional transferring component for transferring the developed image from the photoreceptor to another member or a copy substrate or receiving member. The imaging device comprises a device to enable transfer of the image from the photoreceptor to a receiving member, such as, a paper. The imaging device also contains a component for affixing the finely divided pigmented material onto the receiving member.

The imaging device also comprises a device to recharge the photoreceptor to remove all charge from the surface thereof to provide a cleared surface on the photoreceptor to accept a new image without any remnants of the prior image.

Various aspects of the embodiments of interest now will be exemplified in the following non-limiting examples.

EXAMPLES

Comparative Example 1

On a 30 mm thick aluminum drum substrate was deposited an undercoat layer comprising zirconium acetylacetonate tributoxide (35.5 parts), γ-aminopropyl triethoxysilane (4.8 parts) and poly(vinylbutyral) BM-S (2.5 parts), which were dissolved in n-butanol (52.2 parts). The resulting solution then was coated by a dip coater onto the above aluminum drum substrate and the coating solution layer was preheated at 59° C. for 13 minutes, humidified at 58° C. (dew point=54° C.) for 17 minutes and then dried at 135° C. for 8 minutes. The thickness of the resulting undercoat layer was approximately 1.3 μm.

A photogenerating layer, 0.2 μm in thickness comprising chlorogallium phthalocyanine (Type C) was deposited on the above undercoat layer. The photogenerating layer coating dispersion comprised 2.7 g of chlorogallium phthalocyanine (ClGaPc) Type C pigment, 2.3 grams of the polymeric binder, carboxyl-modified vinyl copolymer, VMCH, available from Dow Chemical Company, 15 g of n-butyl acetate and 30 g of xylene. The resulting mixture was mixed in an Attritor mill with about 200 g of 1 mm Hi-Bea borosilicate glass beads for about 3 hours. The dispersion mixture then was filtered through a 20 μm Nylon cloth filter and the solids content of the dispersion was diluted to about 6 weight %.

Subsequently, a 34 μm charge transport layer was coated on top of the above photogenerating layer from a solution prepared by dissolving N,N-diphenyl-N,N-bis(3-methylphenyl)-1,1'-biphenyl-4,4'-diamine (mTBD, 4 g) and a film-forming polymer binder, PCZ-400 [poly(4,4'-dihydroxy-diphenyl-1-1-cyclohexane carbonate), $M_w$=40,000] available from Mitsubishi Gas Chemical Company, Ltd. (6 g), in a solvent mixture of 21 g of tetrahydrofuran (THF) and 9 g of toluene. The CTL was dried in an oven at about 120° C. for about 40 minutes. The resulting CTL layer had a PCZ-400/mTBD ratio of 60/40.

Comparative Example 2

A photoconductor was prepared by repeating the process of Comparative Example 1 except that the 34 μm thick CTL was coated on the photogenerating layer from a dispersion prepared from N,N-diphenyl-N,N-bis(3-methylphenyl)-1,1'-biphenyl-4,4'-diamine (4 g), a film-forming polymer binder, PCZ-400 [poly(4,4'-dihydroxy-diphenyl-1-1-cyclohexane carbonate), $M_w$=40,000], available from Mitsubishi Gas Chemical Company, Ltd. (6 g) and polytetrafluoroethylene, PTFE POLYFLON™ L-2 microparticles, available from Daikin Industries, (1 g) dissolved/dispersed in a solvent mixture of 21 g of THF and 9 g of toluene via a CAVIPRO™ 300 nanomizer (Five Star Technology, Cleveland, Ohio) followed by drying in an oven at about 120° C. for about 40 minutes. The CTL PCZ-400/charge transport component/PTFE L-2 ratio was 54.5/36.4/9.1.

Example 1

Preparation of Spirodilactam-Doped CTL Composition

A photoconductor was prepared by repeating the process of Comparative Example 1 except that the 34 μm thick CTL was coated on the photogenerating layer from a dispersion prepared from N,N'-diphenyl-N,N-bis(3-methylphenyl)-1,1'-biphenyl-4,4'-diamine (4 g), the film-forming polymer binder, PCZ-400 [poly(4,4'-dihydroxy-diphenyl-1-1-cyclohexane carbonate), $M_w$=40,000] available from Mitsubishi Gas Chemical Company, Ltd. (5.3 g), the spirodilactam copolymer (0.7 g), which copolymer is represented by

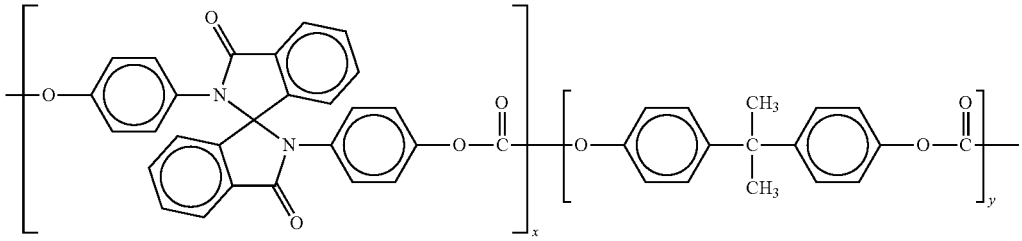

wherein x is equal to 6 mole %, y is equal to 94 mole % and with a weight average molecular weight of 60,000, obtained from Shell Development Company, Houston, Tex., and polytetrafluoroethylene, PTFE POLYFLON™ L-2 microparticles, available from Daikin Industries (1 g), dissolved/dispersed in a solvent mixture of 21 grams of THF and 9 g of toluene. The CTL PCZ-400/spirodilactam copolymer/mTBD/PTFE L-2 ratio was about 48.2/6.3/36.4/9.1 based on the above initial feed amounts.

Example 2

Comparative Studies

Electrical Property Testing

The above prepared photoconductors of Comparative Example 2 and of Example 1 were tested in a scanner set to obtain photoinduced discharge cycles, sequenced at one charge-erase cycle followed by one charge-expose-erase cycle, wherein the light intensity was incrementally increased with cycling to produce a series of photoinduced discharge characteristic curves (PIDC) from which the photosensitivity and surface potentials at various exposure intensities were measured. Additional electrical characteristics were obtained by a series of charge-erase cycles with incrementing surface potential to generate several voltage versus charge density curves. The scanner was equipped with a scorotron set to a constant voltage charging at various surface potentials. The photoconductors were tested at surface potentials of 700 volts with the exposure light intensity incrementally increased by regulating a series of neutral density filters; the exposure light source was a 780 nm light emitting diode. The xerographic simulation was conducted in an environmentally controlled light tight chamber at dry conditions (10% relative humidity and 22° C.).

The above prepared photoconductors exhibited substantially similar PIDCs. Thus, incorporating a lubricant and a spirodilactam in the CTL of Example 1 did not adversely impact the electrical properties of the photoconductor.

Wear Test

Wear tests of the photoconductors of Comparative Examples 1 and 2 and Example 1 were performed using an in house wear test fixture (biased charging roll (BCR) with charging of peak to peak voltage of 1.45 kilovolts. The total thickness of each photoconductor was measured via Permascope (Helmut Fischer) before each wear test was initiated. Then the photoconductors were separately placed in the wear fixture for and tested 50 kilocycles. The total photoconductor thickness was measured again with the Permascope, and the difference in thickness was used to calculate wear rate (nanometers/kilocycle) of the photoconductors. The smaller the wear rate, the more wear resistant was the photoconductor. The wear rate data is summarized in Table 1.

TABLE 1

| | Wear Rate (Nanometers/ Kilocycle) |
|---|---|
| Comparative Example 1 (No Additive in CTL) | 58 |
| Comparative Example 2 (9.1% of PTFE in CTL) | 30 |
| Example I (9.1% of PTFE and 6.3% of spirodilactam copolymer in CTL) | 17 |

When PTFE was incorporated into the CTL, the wear rate was reduced from about 58 nm/kcycle (Comparative Example 1) to about 30 nm/kcycle (Comparative Example 2). When the disclosed spirodilactam copolymer was further incorporated into the PTFE containing CTL, the wear rate was further reduced from about 30 nm/kcycle (Comparative Example 2) to about 17 nm/kcycle (Example 1). A combination of the disclosed spirodilactam copolymer and the lubricant, PTFE in the CTL reduced the wear rate from about 58 nm/kcycle (Comparative Example 1) to about 17 nm/kcycle (Example 1), about a 70% wear reduction.

All references cited herein are herein incorporated by reference in entirety.

It will be appreciated that variants of the above-disclosed and other features and functions, or alternatives thereof, may be combined with other and different systems or applications. Various presently unforeseen or unanticipated alternatives, changes, modifications, variations or improvements subsequently may be made by those skilled in the art to and based on the teachings herein without departing from the spirit and scope of the embodiments, and which are intended to be encompassed by the following claims.

The invention claimed is:

1. A photoreceptor charge transport layer (CTL) comprising a film-forming material, a lubricant, a charge transport material and a spirodilactam/carbonate copolymer.

2. The CTL of claim 1, wherein said lubricant comprises a fluorocarbon.

3. The CTL of claim 2, wherein said fluorocarbon comprises a polytretrafluorocarbon.

4. The CTL of claim 3, wherein said polytetrafluorocarbon comprises a polytetrafluoroethylene.

5. The CTL of claim 1, wherein said carbonate copolymer comprises a bisphenol A.

6. The CTL of claim 1, wherein said lubricant comprises from about 3% to about 10% of said CTL.

7. The CTL of claim 1, wherein said copolymer has a $T_g$ greater than about 180° C.

8. The CTL of claim 1, wherein said spirodilactam/carbonate copolymer comprises:

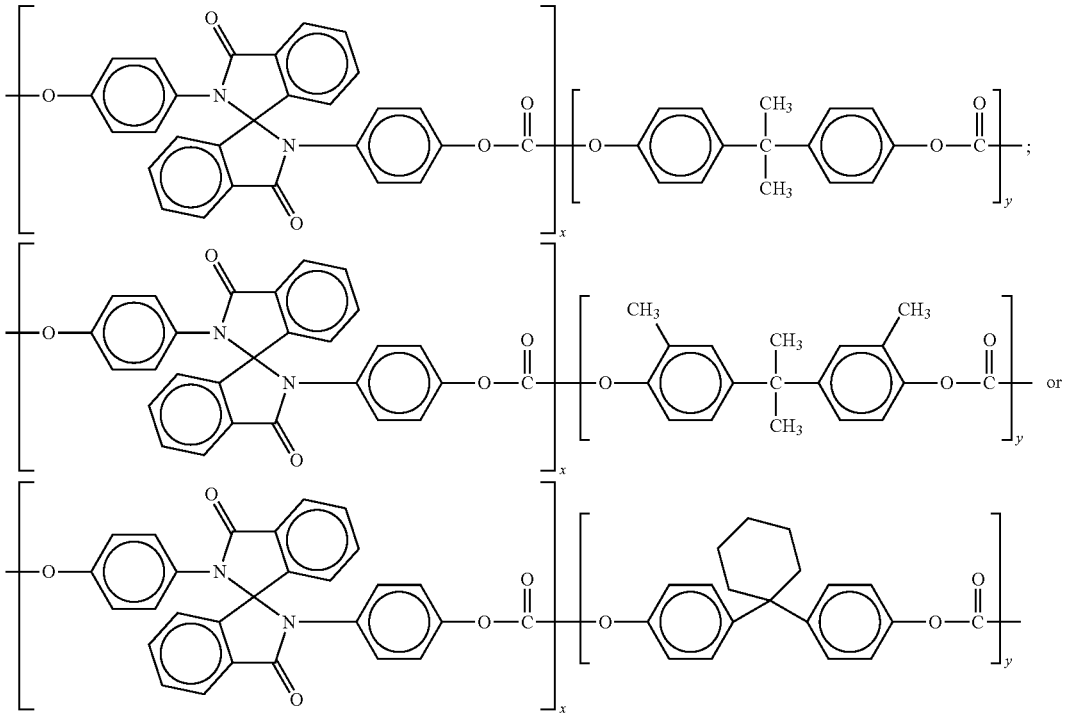

wherein x is from about 1 mole % to about 30 mole %, y is from about 70 mole to about 99 mole and where the sum of x and y is 100 mole %.

9. The CTL of claim 1, wherein said spirodilactam comprises from about 1% to about 10% of said copolymer.

10. A photoreceptor comprising:

the CTL of claim 1;

a substrate;

a hole blocking layer and/or undercoat layer; and a charge generating layer.

11. An imaging device component comprising the photoreceptor of claim 10, wherein said photoreceptor further comprises an anti-curl back coating layer.

12. An imaging device comprising the photoreceptor of claim 10, wherein the imaging device further comprises;

a device for producing and removing an imagewise charge on said photoreceptor;

a developing component for applying colored, dyed, or pigmented particles or toner to a charge retentive surface on said photoreceptor;

an optional transferring component for transferring the developed image from said photoreceptor to a substrate or receiving means; and a component for affixing the colored, dyed, or pigmented particles or toner onto the substrate or receiving member.

13. The imaging device component of claim 11, wherein said photoreceptor has a wear rate about 40% less than of a photoreceptor lacking a lubricant.

14. The imaging device component of claim 13, wherein said photoreceptor has a wear rate about 60% less than of a photoreceptor lacking a lubricant and a spirodilactam.

15. An imaging device comprising:

the photoreceptor of claim 10, wherein said photoreceptor has a wear rate about 40% less than of a photoreceptor lacking a lubricant;

a device for producing and removing an imagewise charge on said photoreceptor;

a developing component for applying colored, dyed, or pigmented particles or toner to a charge retentive surface on said photoreceptor;

a transferring component for transferring the developed image from said photoreceptor to a substrate or receiving means; and a component for affixing the colored, dyed, or pigmented particles or toner onto the substrate or receiving member.

16. The imaging device of claim 15, wherein said lubricant comprises a fluorinated rein.

17. The imaging device of claim 15, wherein said photoreceptor has a wear rate about 60% less than of a photoreceptor lacking a lubricant and a spirodilactam.

18. A method of reducing the wear rate of a photoreceptor comprising:

coating a charge generating layer with a composition comprising a lubricant, a film-forming material, a charge transport material and a spirodilactam/carbonate copolymer to form a charge transport layer of a photoreceptor, thereby extending the life of said photoreceptor compared to a photoreceptor where no lubricant or spirodilactam is added.

19. The method of claim 18, wherein said lubricant comprises a fluorinated resin.

20. The method of claim 18, wherein said carbonate copolymer comprises a bisphenol A.

* * * * *